US005182569A

United States Patent [19]

Bui-Hai

[11] Patent Number: 5,182,569

[45] Date of Patent: Jan. 26, 1993

[54] ANTENNA HAVING A CIRCULARLY SYMMETRICAL REFLECTOR

[75] Inventor: Nhu Bui-Hai, Le Vesinet, France

[73] Assignee: Alcatel N.V., Amsterdam, Netherlands

[21] Appl. No.: 656,123

[22] Filed: Feb. 14, 1991

Related U.S. Application Data

[63] Continuation of Ser. No. 410,972, Sep. 22, 1989, abandoned.

[30] Foreign Application Priority Data

Sep. 23, 1988 [FR] France ..... 88 12458
Sep. 23, 1988 [FR] France ..... 88 12459
Oct. 20, 1988 [FR] France ..... 88 13781

[51] Int. Cl.[5] ..... H01Q 19/19; H01Q 15/16; H01Q 1/12

[52] U.S. Cl. ..... 343/781 CA; 343/840; 343/912

[58] Field of Search ..... 343/781 P, 781 CA, 786, 343/912, 840, 837, 781 R; 333/21 A

[56] References Cited

U.S. PATENT DOCUMENTS

| | | | |
|---|---|---|---|
| 3,518,686 | 6/1970 | Siebecker | 343/755 |
| 3,534,375 | 10/1970 | Paine | 343/779 |
| 3,716,869 | 2/1973 | Gould, Jr. et al. | 343/779 |
| 3,737,909 | 6/1973 | Bartlett et al. | 343/755 |
| 3,758,880 | 9/1973 | Mörz | 333/122 |
| 4,106,026 | 8/1978 | Bui-Hai et al. | 343/786 |
| 4,194,209 | 3/1980 | Coulbourn, Jr. | 343/753 |
| 4,222,017 | 9/1980 | Foldes | 333/21 A |
| 4,263,599 | 4/1981 | Bielli et al. | 343/781 R |
| 4,473,828 | 9/1984 | Mörz et al. | 343/786 |
| 4,521,783 | 6/1985 | Bryans et al. | 343/781 R |
| 4,636,801 | 1/1987 | Myer | 343/781 CA |
| 4,783,664 | 11/1988 | Karikomi et al. | 343/781 CA |
| 4,837,531 | 6/1989 | Gourlain et al. | 333/21 A |

FOREIGN PATENT DOCUMENTS

| | | | |
|---|---|---|---|
| 0816424 | 10/1951 | Fed. Rep. of Germany | 343/786 |
| 2551545 | 5/1977 | Fed. Rep. of Germany | 343/912 |
| 3326527 | 9/1984 | Fed. Rep. of Germany | 343/786 |
| 03957 | 1/1974 | U.S.S.R. | 343/781 CA |
| 0873317 | 10/1981 | U.S.S.R. | 343/912 |
| 0989395 | 4/1965 | United Kingdom | 343/912 |
| 1088175 | 10/1967 | United Kingdom | 343/912 |
| 2145569 | 3/1985 | United Kingdom | 343/912 |

OTHER PUBLICATIONS

Kildal et al., Scalar Horn with Shaped Lens Improves Cassegrain Efficiency, IEEE Trans. on Antennas & Propagation, vol. AP32, No. 10, Oct., 1984, pp. 1094–1100.

(List continued on next page.)

*Primary Examiner*—Rolf Hille
*Assistant Examiner*—Peter Toby Brown
*Attorney, Agent, or Firm*—Brunell & May

[57] ABSTRACT

A microwave antenna has a circularly symmetrical reflector made of a material having a liquid phase and a solid phase, with the reflector being obtained by centrifuging the material while in its liquid phase and then allowing it to pass into its solid phase. This results in a convex paraboloidal reflector face having a very high degree of surface accuracy. When housed inside a microwave absorbing ring connecting the reflector face to a microwave-transparent window and used with a suitable source held at a predetermined focus position between the reflector and the window by means of microwave absorbent triangular struts, the antenna demonstrates improved radio and mechanical properties. Alternately, the centrifugally cast convex paraboloidal reflector may be used as the main reflector in a hybrid Cassegrain optical system in which the subreflector has a "conformed" non-paraboloidal surface that is machined from a solid piece of material. This results in an antenna that is easy to manufacture, and yet has much of the improved radio performance associated with the use of "conformed" surfaces for both reflectors. By also using a "conformed" lens at the aperture of the source, performance of such a hybrid system is further enhanced.

7 Claims, 7 Drawing Sheets

OTHER PUBLICATIONS

Rusch, W. T., The Current State of the Reflector Antenna Art, IEEE Trans. on Antennas & Propagation, vol. AP32, No. 4, Apr., 1984, pp. 313-329.

Rusch, W. T., Forward Scattering from Cylinders of Triangular Cross Section, IEEE Transactions on Antennas & Propagation, vol. AP-26, No. 6, Nov. 1978, pp. 849-850.

Du et al. Microwave Lens Design for a Conical Horn Antenna Microwave Journal Sep. 1976 pp. 49-52.

"Antennes Du Type A Reflecteur Paraboloidal", Antennes Micro-Ondes, pp. 62 through 80, Nhu BUI--HAI, published by Masson, 1978.

Patent Abstracts of Japan, vol. 8, No. 13, (E-222)(1450), Jan. 20, 1984; & JP-A-58 178 606, (Shiyouwa Muen Kogyo) Oct. 19, 1983.

Soviet Invention Illustrated, section electrique, semaine L 32, WO 2, agrege No. K6991, Derwent Publications Ltd.; & SU -A-873 317 (NW CORRESPPOLY).

"A high-efficiency Cassergrain antenna", GEC Telecommunications, No. 40, 1975, pp. 52-56; D. W. Bolwell.

"New techniques for high efficiency reflector antennas", Proceedings 1971 European Microwave Conference, Stockholm, Sweden, Aug. 1971, pp. B4/1:1-B4/1:4.

Patent Abstracts of Japan, vol. 6, No. 87, (E-108)[965], May 25, 1982, & JP-A-57 23 304 (Nippon Denki K.K.), 0602-1982.

"Centrifugal Forming of Paraboloidal Antennas", The Microwave Journal, J. R. Jenness, Jr. et al., vol. 4, No. 6, Jun. 1961.

"Spuncast Plastics Achieve Reflector Precision", Electronics, vol. 35, No. 48, Nov. 30, 1962, J. W. Dawson, pp. 134,136,138,140,142.

Patent Abstracts of Japan, vol. 8, No. 131 (E-251)[1568], Jun. 19, 1984 & JP-A-59 41 905 (Fujitsu K.K.), Mar. 8, 1984.

"Improving the radiation characteristics of aperture antennas", Conference Record-1987 International Conference on Communications, Toronto, Jun. 4-7, 1978, vol. 3, pp. 35.4.1-35.4.5, IEEE, New York, US; H. Yokoi et al.

M. Ducos, "Revêtements par projection thermique", *Techniques de l'ingéneur,* Jan. 1989, M 1645, pp. 1-23.

ANTENNA HAVING A CIRCULARLY SYMMETRICAL REFLECTOR

CROSS-REFERENCE TO RELATED APPLICATIONS

This is a continuation of application Ser. No. 07/410,972, filed Sep. 22, 1989 now abandoned.

The invention relates to an antenna having a circularly symmetrical reflector.

BACKGROUND OF THE INVENTION

There are several types of such an antenna: for example the antenna may be a single-reflector antenna.

As described in the work by Mr. Nhu BUI HAI, entitled "Antennes micro-ondes" ("Microwave antennas") (published by Masson, 1978), an antenna of this type having its reflector illuminated by a primary source placed at its focus is commonly used in frequency bands above 400 MHz.

Such an antenna comprises a reflector, which is generally circularly symmetrical, and a primary source which is generally of the horn type when the operating wavelength is in the centimeter range, and of the dipole type including a reflector when the operating wavelength is in the decimeter range.

For a circularly symmetrical paraboloidal reflector having a surface tolerance of about $\pm\lambda/16$, where $\lambda$ is the working wavelength, and for a horn type of primary source, the efficiency of such an antenna lies in the range 0.45 to 0.55.

One of the main factors having a considerable effect on antenna efficiency lies in loss of gain due to the surface tolerance of the circularly symmetrical paraboloidal reflector. Thus, a surface tolerance of $\pm\lambda/16$ loses about 0.4 dB and increases the diffuse radiation level by about 15 dB.

The present invention seeks to reduce these effects considerably.

Another such antenna is an antenna having Cassegrain optics.

Antennas having Cassegrain optics with circularly symmetrical reflectors are well known. They comprise a main reflector of the paraboloidal type, a subreflector which is either a hyperboloid or an ellipsoid, and a primary source.

They provide the following performance characteristics:

In co-polarization:

- level of first secondary lobe: about −16 dB/maximum;
- efficiency: about 0.55 to 0.65; and
- far lobe levels: in the range −5 dB to −15 dB below the isotropic level; and In cross-polarization:

- on axis level: about −35 dB; and
- maximum level: −22 to −30 dB/maximum.

Assuming that the primary source provides very good performance (e.g. a corrugated type of horn with an exponential profile), then the performance of a Cassegrain antenna depends essentially on the mechanical qualities of the reflectors, i.e.:

- the accuracy of the profiles of the main reflector and of the subreflector;
- the accuracy of the relative positioning between these two reflectors; and

- the shape, quantity, and positioning accuracy of the support arms for the subreflector.

The worse these criteria, the worse the radiating performance of the antenna. Thus, for a profile tolerance $\epsilon$ relative to the wavelength $\lambda$, i.e. for a ratio $\epsilon/\lambda$ of about $\pm 1/20$, the performance of a Cassegrain antenna having circularly symmetrical reflectors is as specified above.

When only analog radio beams were in use, such performance corresponded to requirements. Now that digital radio beams are being used, cross-polarization performance has become crucial. It is a function, in particular, of the quality of modulation: 4, 16, 64, or 256 quadrature amplitude modulation (QAM).

Thus, for a given form of modulation, there may be a corresponding value of cross-polarization, e.g. as follows:

16 QAM→−22 to −32 dB/maximum
64 QAM→−28 to −38 dB/maximum
256 QAM→−35 to −45 dB/maximum.

Consequently, with 64 QAM digital radio beams, there already exists a need to select component parts for the antenna such that the cross-polarization is lower than in existing antennas. And for 256 QAM digital radio beams, the cross-polarization performance of existing antennas is quite unsatisfactory.

In addition, in order to increase the illumination efficiency in a Cassegrain antenna having circularly symmetrical reflectors, attempts are made to obtain amplitude distribution in its aperture which is uniform and equiphase, while continuing to use a primary source which provides tapering illumination. To do this, two new reflector profiles are defined and referred to as being "shaped". The main reflector is a pseudo-paraboloid and the subreflector is a pseudo-hyperboloid. By "shaping" the profile of the subreflector, the illumination of the main reflector is made uniform, and by "shaping" the main reflector, the illumination in the aperture of the antenna is made equiphase. However, when such a "shaped" (pseudo-hyperboloid) subreflector is used, the source which must be placed at the focus situated between the main reflector and the subreflector provides a degree of masking for the wave emitted or received by the antenna.

An object of the invention is therefore to solve these various problems.

SUMMARY OF THE INVENTION

The present invention provides an antenna including at least one circularly symmetrical reflector, wherein the reflector is made of a material having a liquid phase and a solid phase, and is obtained by centrifuging the material while in its liquid phase and subsequently passing to its solid phase.

Such an antenna having a centrifuged reflector makes it possible to obtain the following improvements:

- about 0.3 dB of gain;
- about ten decibels in diffuse radiation levels;
- a drop of about 10 dB to 15 dB in cross-polarization level; and these are achieved using the same primary source.

BRIEF DESCRIPTION OF THE DRAWINGS

Embodiments of the invention are described by way of example with reference to the accompanying drawings, in which.

DETAILED DESCRIPTION

Figure 1:
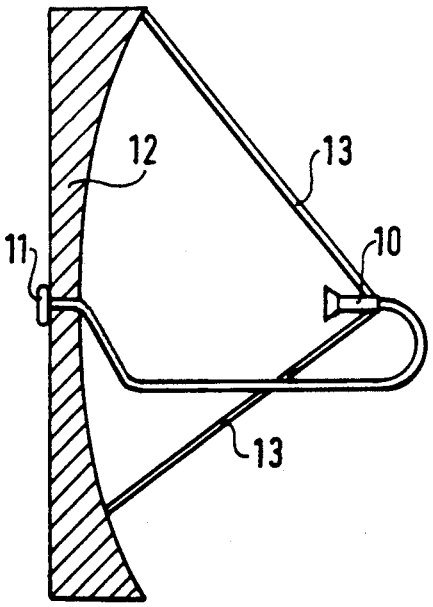
FIGS. 1 and 2 are diagrams of a first variant of an antenna of the invention shown respectively in longitudinal section and in front view.
Figure 2:
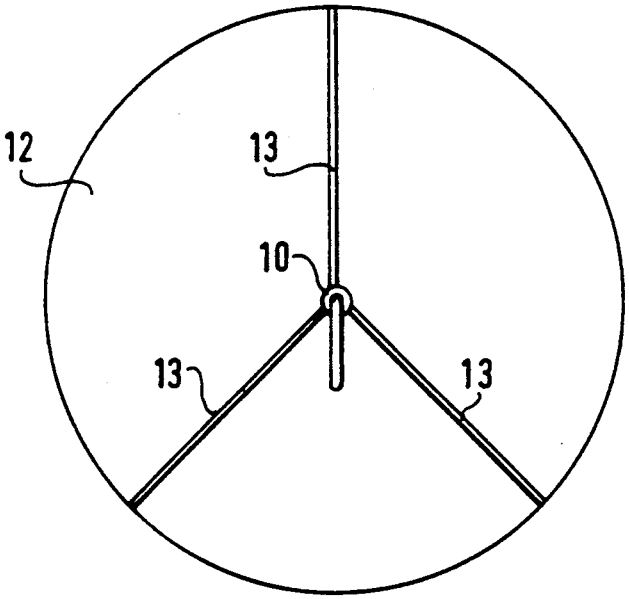

A first variant of the antenna of the invention is shown in FIGS. 1 and 2 and comprises a single reflector antenna having a primary source 10 which is a unipolar source having an access flange 11, and a reflector 12 obtained by centrifuging a material while in the liquid state and allowing it to solidify. The source 10 is held in place by support rods 13 which may be triangular in section, with the edge of the triangle facing the concave paraboloidal face of the reflector 12.

The invention thus replaces the conventional circularly symmetrical paraboloidal reflector made either of laminated glass or else of metal, by a paraboloidal reflector of extremely small surface tolerance as obtained by centrifuging a substance in the liquid state such as a molten plastic or a molten metal (e.g. copper or aluminum).

When the reflector is obtained by centrifuging a plastic material (e.g. polyester), it is subsequently coated with a layer of metal (e.g. by depositing a layer of zinc having a thickness of a few tens of micrometers, using the Schoop process).

The radius of curvature and the focal length of such a reflector depend on the speed of centrifuging. The tolerance of a reflector obtained in this way is about 0.1 mm.

Figure 3:
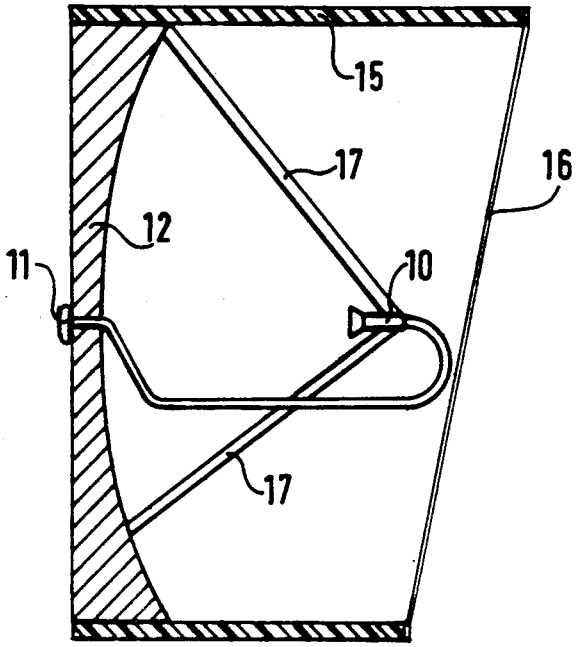
FIG. 3 shows the first variant of the invention as shown in FIG. 1 together with the addition of other components.

As shown in FIG. 3, a single reflector antenna may have a ring 15 mounted therearound fitted with absorbant material and closed with a flat window 16 so as to obtain better resistance to wind and also to obtain a maximum level of radiation at more than 80° from the axis which is ten to fifteen decibels lower. This variant improves the radio performance of an antenna of the invention.

As also shown in FIG. 3, in order to further increase cross-polarization performance, the support rods 13 of the primary source may be coated with microwave-absorbing material 17. Depending on the angle under consideration, cross-polarized radiation levels may thus be lowered by a few decibels to about ten decibels.

Advantageously, when a conventional paraboloidal reflector of an antenna is replaced by a centrifuged paraboloidal reflector of the invention having the same diameter and the same focal length, the fixing and mounting system remains unchanged. The only change lies in the radio performance of the antenna, and this is considerably improved.

In order to take advantage of the improved cross-polarization performance, it is advantageous to use a primary source of the corrugated horn type.

In one embodiment, an antenna having a centrifuged paraboloidal reflector illuminated by a primary source placed at its focus may be considered, having the following characteristics:

antenna diameter: 3.60 meters (m);

ratio of focal length to diameter: 0.43;

surface tolerance of the centrifuged reflector: $\leqq \pm 0.1$ mm; and frequency band: 5.925 GHz to 6.425 GHz.

Figure 4:
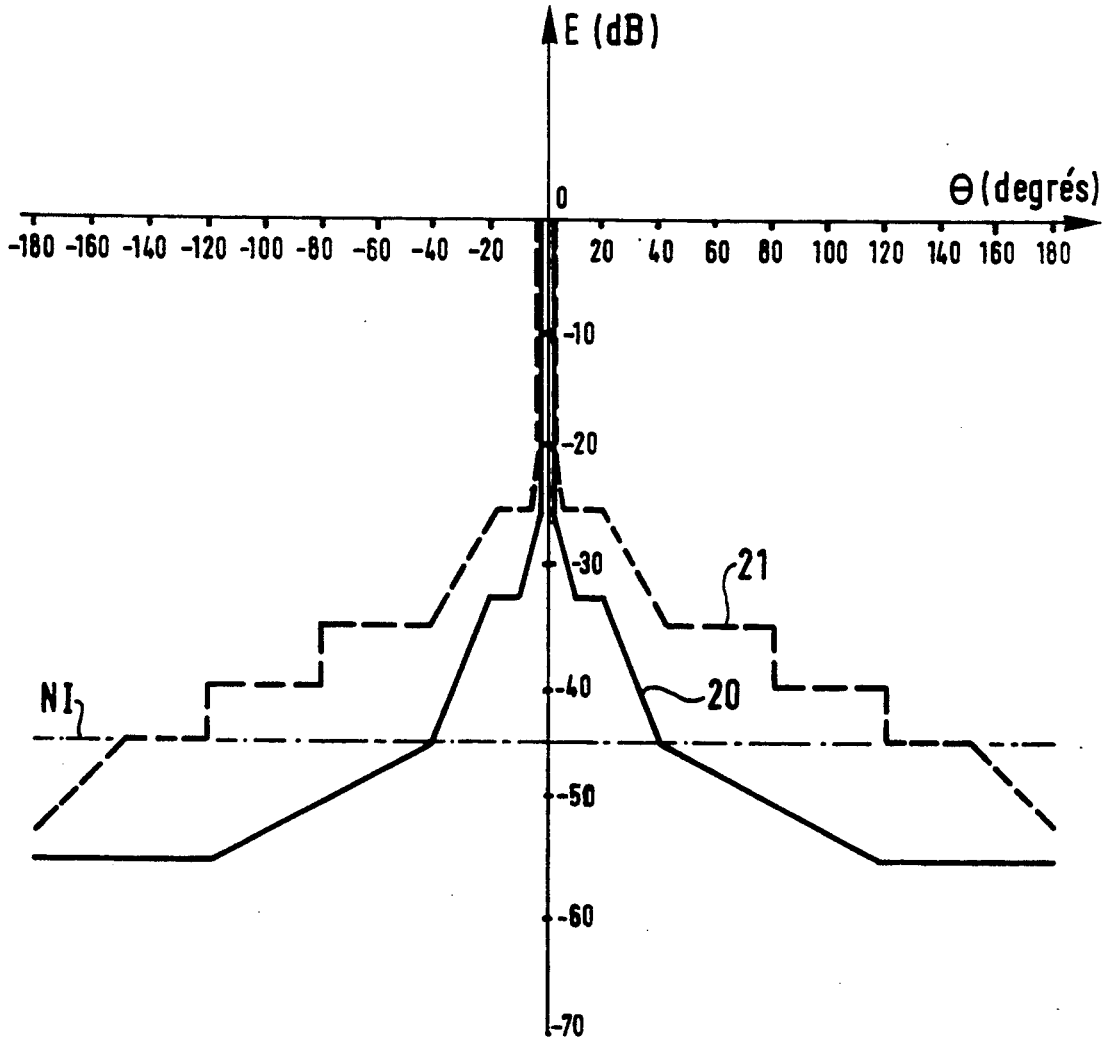
FIGS. 4 and 5 are graphs representative of the performance of the first variant of an antenna of the invention.

The resulting curve 20 as shown in FIG. 4 represents the envelope of the co-polarization radiation pattern, i.e. $E=f(\theta)$, where $\theta$ is an angle measured in degrees, and should be compared with the same curve 21 as obtained for an antenna using a conventional paraboloidal reflector, with NI representing the isotropic level.

Figure 5:
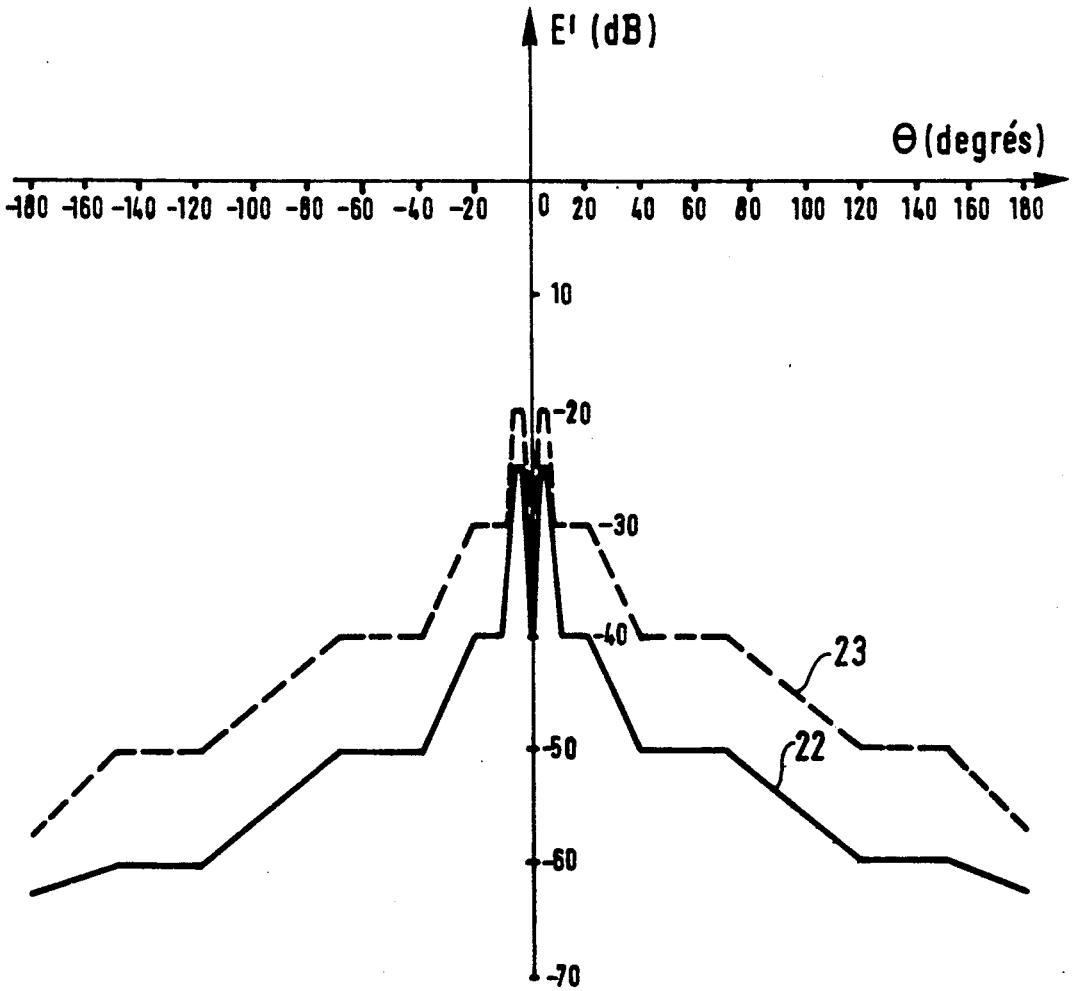

A curve 22 is also obtained representative of the envelope of the cross-polarization radiation pattern with $E'=f(\theta)$ as shown in FIG. 5, which should be compared with the same curve 23 obtained using an antenna having a conventional paraboloidal reflector.

Figure 6:
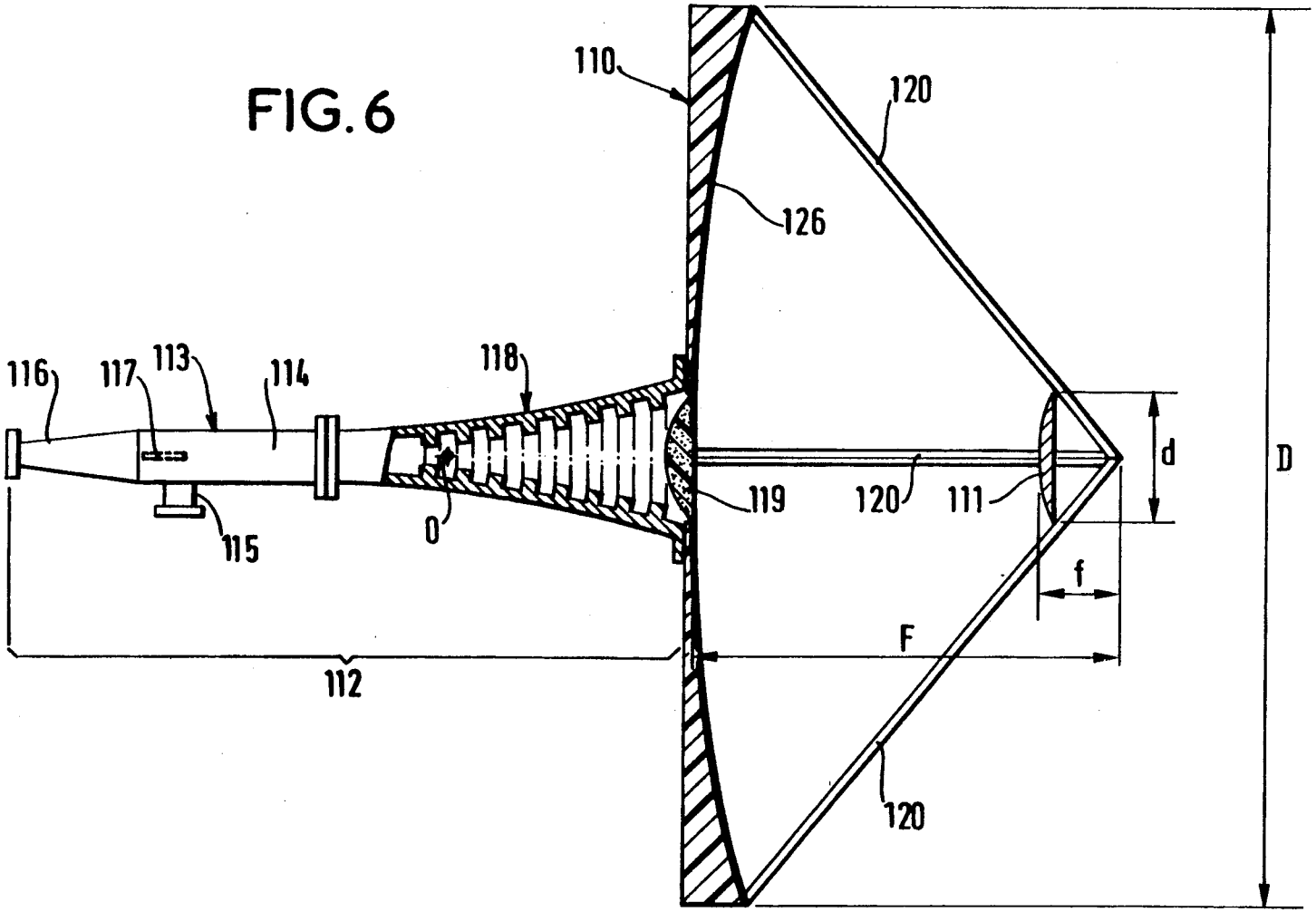
FIG. 6 is a fragmentary longitudinal section view through a second variant antenna of the invention.

A second variant antenna of the invention has Cassegrain optics, as shown in FIG. 6, and comprises:

Two confocal paraboloid reflectors 110 and 111 having the same ratio of focal length to diameter, i.e. $f/d=F/D$. The main reflector 110 is obtained by the above-defined centrifuging technique, either using a metal such as copper or aluminum or else by applying a metal deposit 126 to polyester, for example. The subreflector 111 may be obtained by machining a solid. The accuracy of the paraboloidal profiles is thus excellent: errors less than $\pm 0.1$ mm peak-to-peak. This is to be compared with current reflectors which are manufactured either by molding laminated polyester material or else by metal spinning or else by stamping. Any of these techniques generally gives rise to a peak-to-peak error of more than one millimeter for reflectors having a diameter of four meters. These parameters contribute to a large extent to the reduced cross-polarization values.

A primary source 112 of the corrugated horn type a general exponent profile 118. The source is defined to have a phase center O which is as stationary as possible, thereby making it possible to obtain excellent cross-polarization performance over a wide frequency band. A polarization duplexer 113 is disposed at the free end of the corrugated horn 118.

This polarization duplexer 113 operates with two orthogonal polarizations that are vertical and horizontal, and comprises a portion 114 in the form of a circular waveguide together with two accesses 115 and 116 in the form of rectangular waveguides, with the second access 116 being in alignment with the circular waveguide 114 and with a reflector plate 117 being disposed between the level of the first access 115 and the second access 116.

This duplexer thus serves to combine these two horizontal and vertical orthogonal linear polarizations. If a bipolar wave arrives at the inlet to the circular waveguide 114, the horizontally polarized wave strikes the reflector plate 117 which is parallel thereto. It is reflected and passes into the first access 115 whereas the vertically polarized wave passes normally and perpendicularly to the reflector plate 117 and reaches the second access 116. Since reciprocity applies, a wave arriving via the first access 115 is reflected on the reflector plate 117 and exits via the circular waveguide 114. The second access 116 is so-to-speak "balanced" since the wave reaching this access enters the circular waveguide 114 via its center. However the first access 115 which is connected to the side of the circular waveguide 114 is "asymmetrical" and not balanced.

There is a lens 119 at the aperture of the corrugated horn 118. It serves to transform the spherical wave from the corrugated horn into a plane wave. It has parabolic and flat surfaces, with the focus of the lens 119 coinciding with the phase center O of the corrugated horn 118. It is made of a dielectric material, e.g., polytetrafluoroethylene or "Teflon".

Most current high-efficiency Cassegrain antennas (efficiency about 0.70 to 0.75) have main and auxiliary reflectors 110 and 111 with "conformed" profiles, i.e., profiles which are deformed in such a manner that the illumination phase reflected from the main reflector 110 becomes very small in practice (a few degrees instead of several tens of degrees), and the amplitude reflected by the subreflector 111 becomes uniform. However, in an antenna of the invention, the profile of the main reflector 110 is constrained to be paraboloidal because of the centrifuging technique. A deformed or "conformed" profile cannot be obtained by such centrifuging. However, since the subreflector 111 is machined in a solid, it can be conformed so as to have a different profile. The efficiency of this antenna is about 0.65 to 0.70.

In this variant, in order to obtain an antenna having improved efficiency, the two reflectors 110 and 111 as described above may be retained while the lens 119 is, in addition, "conformed" in profile so as to alter its phase pattern, thereby enabling the main reflector 110 to be illuminated in a manner which is as equiphase as possible. The efficiency is then improved a little, tending towards 0.67 to 0.72, i.e., for a centrifuged main reflector 110 and a conformed subreflector 111, the lens 119 can be conformed in such a manner for waves emitted or received by the main reflector 110 that conformation of the lens is practically equivalent to conformation of the main reflector 110. Such a variant of the antenna of the invention can be made in two different ways, in particular:

the first comprises:

- a centrifuged main reflector 110 having a profile which is necessarily paraboloidal; and
- a subreflector 111 which is machined in a solid and which has a conformed profile, however this solution corresponds to a "half-conformed" solution;

the second comprises:

- a centrifuged main reflector 110 whose profile is necessarily paraboloidal;
- a subreflector 111 which is machined in a solid to have a profile which is conformed; and
- a lens 119 whose profile is phase conformed.

Figure 7:
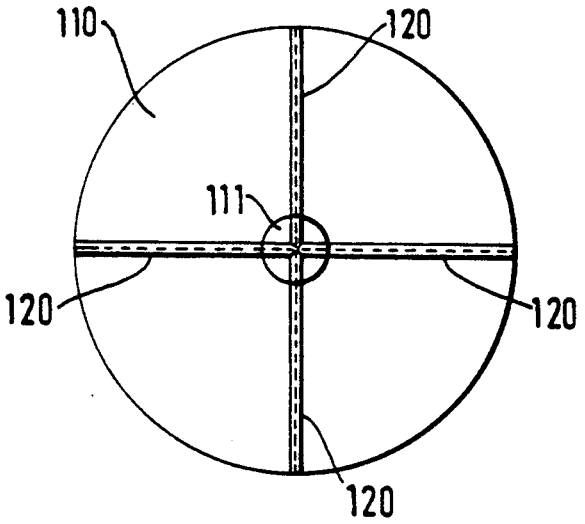
FIG. 7 is a front view of the second variant antenna of the invention.

As shown in FIGS. 6 and 7, the subreflector support 111 is constituted by four rods 120 (or arms) holding and supporting the subreflector 111 accurately. These rods are advantageously placed in a cross-configuration. The four arms 120 are fixed around the circumference of the main reflector 110. In this way, the profile of the reflector retains perfect paraboloidal continuity and is therefore not altered where the four arms are fixed thereto as in prior art antennas. Similarly, the "cross" profile of the four arms, as opposed to an "X" profile makes it possible to avoid having an influence on cross-polarization since each field is concentrated at 45° to the horizontal and vertical axes. In addition, the section of each arm 120 is preferably triangular (an isosceles triangle) with a vertex pointing towards the paraboloidal face of the main reflector 110. In this way, any reflection of the radiated field on the arms 120 is minimized. This contributes to reducing cross-polarization.

Figure 8:
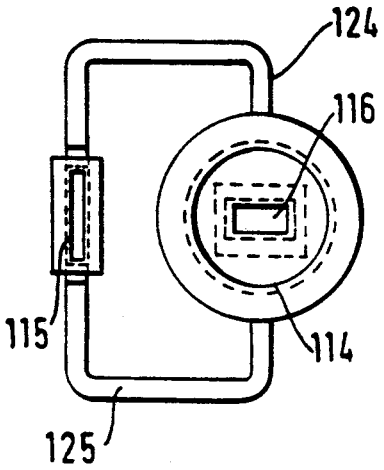
FIGS. 8 and 9 show a variant of the polarization duplexer used in the second variant of an antenna in accordance with the invention, shown respectively in front view and in side view.
Figure 9:
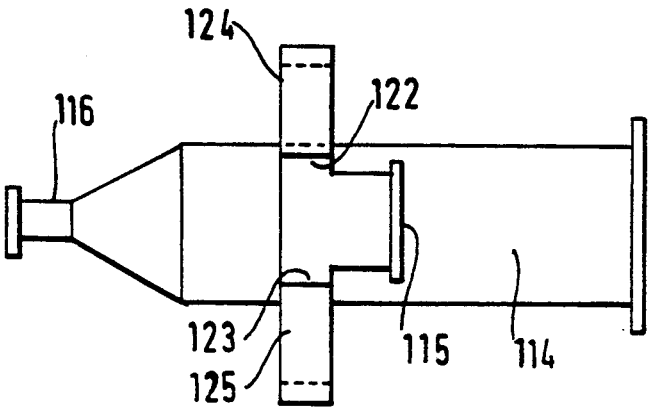

In a variant of the duplexer, as shown in FIGS. 8 and 9, the first access 115 is obtained by means of a "magic-T" whose two arms 122 and 123 meet two diametrically opposite accesses 124 and 125 (of waveguide dimensions) on the circumference of the circular waveguide 114. This device is balanced.

Figure 10:
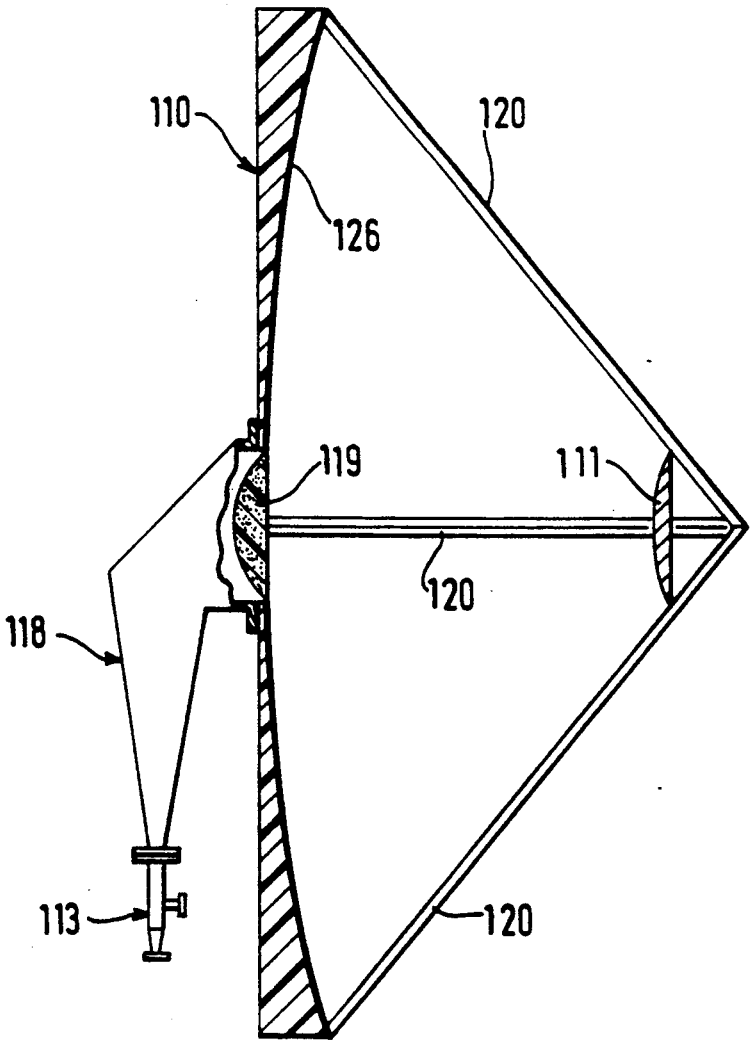
FIG. 10 shows a variant of the source in the second variant antenna of the invention.

In order to reduce the space occupied by the primary source 112, the corrugated horn may be "folded" by means of a 45° plane as shown in FIG. 10, with the horn taking up a vertical position.

Figure 11:
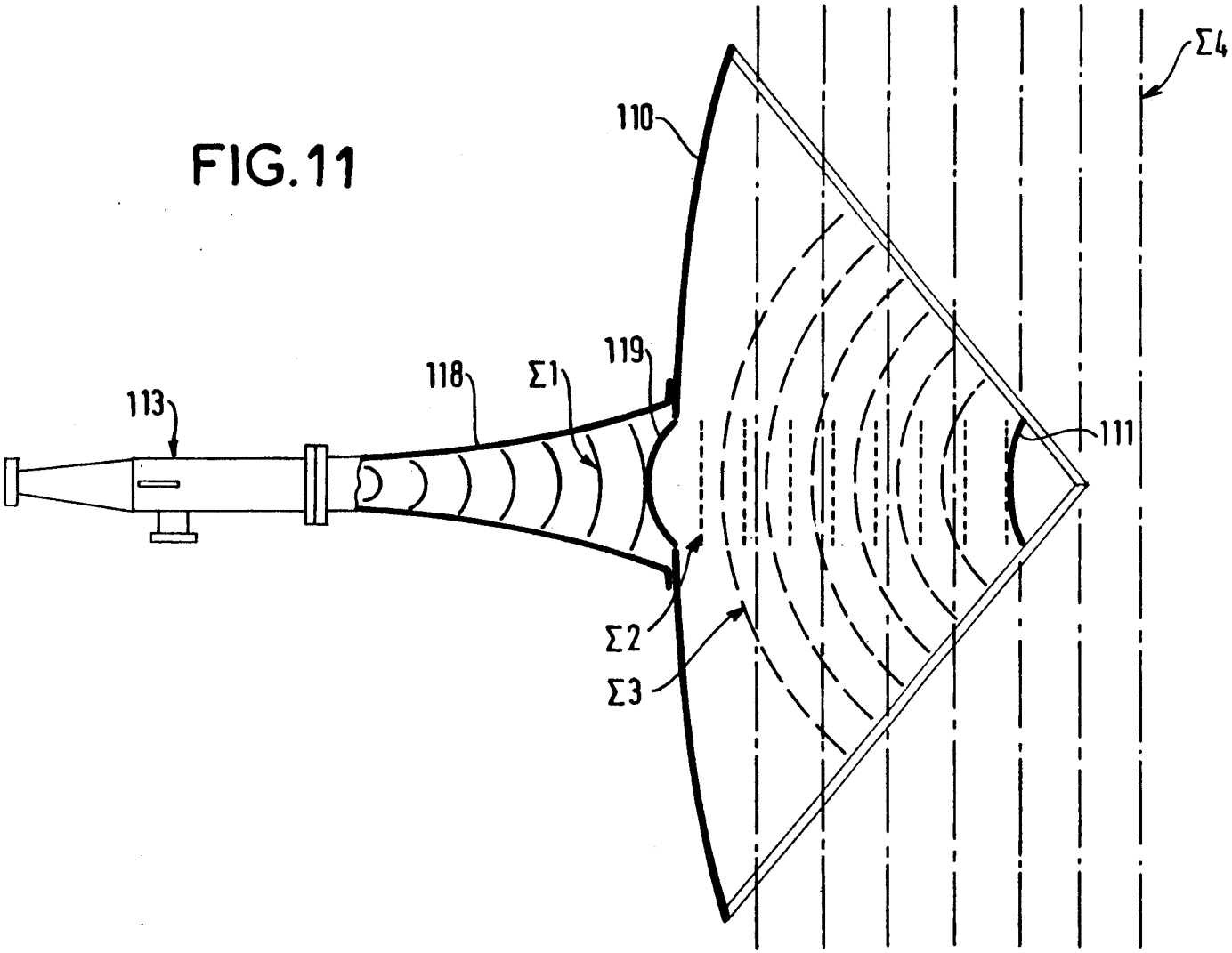
FIG. 11 illustrates the operation of the second variant antenna of the invention.

In operation, as shown diagrammatically in FIG. 11, and assuming that transmission is taking place, a spherical wave Σ1 is formed in the horn aperture 118. It is transformed into a plane wave Σ2 after passing through the lens 119. The plane wave Σ2 is reflected on the parboloidal subreflector 111 and becomes a spherical wave Σ3 which, on being reflected on the paraboloid main reflector 110, becomes a plane wave Σ4 at the outlet from the antenna.

Naturally, the reciprocity principle applies for reception. A plane wave Σ4 coming from infinity is reflected on the paraboloid main reflector 110. It becomes a spherical wave Σ3 after reflection and it strikes the paraboidal subreflector 111. On leaving the subreflector it becomes a plane wave Σ2 which strides the lens 119. The lens transforms it into a spherical wave Σ1 which propagates along the corrugated horn 118. and leaves via the accesses of the polarization duplexer 113.

In an example of operation of this second variant of the invention, the following values are taken into consideration:

- frequency band: 6.43 GHz to 7.11 Ghz;
- diameter of main reflector 10: D=4 m;
- diameter of subreflector 11: d=0.60 m;
- ratio of focal length to diameter: 0.45;
- the main reflector 110 is made by centrifuging, this reflector may be obtained, for example, by centrifuging a plastic material and the depositing a layer of metal on the plastic, e.g., by depositing a layer of zinc having a thickness of a few tens of micrometers using the scoop process (or spraying using a molten metal flame pistol);
- the subreflector 111 is made by machining a solid, e.g., made of a metal such as aluminum;
- reflector profile tolerance: $<\pm 0.1$ mm;
- primary source 112: an exponential profile corrugated horn having an aperture with a diameter of 0.60 m and a length of 0.90 m;
- lens 119 in the aperture of the horn: diameter=0.60 m;
- four triangular section support arms 120 fixed to the circumference of the main reflector in a "cross" configuration;
- cross-polarization value: better than 42 dB; and
- efficiency better than 0.65.

Naturally, the present invention has been described and shown merely by way of preferred examples and its component parts could be replaced by equivalent parts without thereby going beyond the scope of the invention.

Thus, the primary source 112 may be square in shape, rectangular, or circular, and it may be fed from a square section, a rectangular section, or a circular section waveguide, respectively.

Thus, the subreflector 111 need not be confocal with the main reflector 110, but may be a hyperboloid or an ellipsoid. In either case the primary source is then a horn that does not include a lens. In this case, antenna efficiency is reduced but its characteristics remain very good by virtue of the centrifuged main reflector.

I claim:

1. An antenna comprising:

a centrifugally cast main reflector having a circularly symmetrical substantially concave paraboloidal metallic face, with a diameter of at least about 3.6 m;

a subreflector having a circularly symmetrical convex shaped face machined from a solid metal to a surface tolerance of no more than about ±0.1 mm and facing the concave face of the main reflector, said subreflector having a diameter no greater than about 0.6 m, said main reflector and said subreflector forming a Cassegrain optical system wherein the two reflectors have the same ratio of focal length to diameter of about 0.45;

a subreflector support in the form of four arms in a cross-configuration, each of said arms being fixed at one end to the periphery of the main reflector and having a cross section in the form of an isosceles triangle whose apex points in the direction of the main reflector;

an exponential profile corrugate horn aligned with the subreflector and the main reflector for receiving or transmitting microwaves, said corrugated horn defining a phase center and having an aperture end and a free end;

a shaped lens made of a dielectric material and disposed at the aperture end of the corrugated horn with a focus of the lens coinciding with the phase center of the corrugated horn; and a polarization duplexer disposed at the free end of the corrugated horn such that two fields are concentrated at 45° relative to the four arms of the subreflector support.

2. The antenna of claim 1, wherein said centrifugally cast main reflector comprises a centrifugally cast plastic and said metallic face comprises a metal coating deposited over said plastic.

3. The antenna of claim 2, wherein said plastic comprises a polyester and said metal coating comprises zinc.

4. An antenna for a frequency band of 6.43 GHz to 7.11 GHz having a cross polarization better than 42 dB and efficiency better than 0.65, said antenna comprising:

a centrifugally cast main reflector having a circularly symmetrical substantially concave paraboloidal metallic face, with a diameter of about 4 m;

a subreflector having a circularly symmetrical convex shaped face machined from a solid metal to a surface tolerance of no more than about ±0.1 mm and facing the concave face of the main reflector, said subreflector having a diameter no greater than about 0.6 m, said main reflector and said subreflector forming a Cassegrain optical system wherein the two reflectors have the same ratio of focal length to diameter of about 0.45;

a subreflector support in the form of four arms in a cross-configuration, each of said arms being fixed at one end to the periphery of the main reflector and each having a cross section in the form of an isosceles triangle whose apex points in the direction of the main reflector;

an exponential profile corrugated horn aligned relative to the subreflector and the main reflector for receiving or transmitting microwaves, said corrugated horn defining a phase center and having a circular aperture end having a diameter of about 0.6 m and a rectangular free end separated by a length of about 0.9 m;

a lens made of a dielectric material also having a diameter of about 0.6 m and disposed at the aperture end of the corrugated horn with a focus of the lens coinciding with the phase center of the corrugated horn; and a polarization duplexer disposed at the free end of the corrugated horn such that two fields are concentrated at 45° relative to the four arms of the subreflector support.

5. The antenna of claim 4, wherein said polarization duplexer further comprises:

a circular waveguide portion:

a first rectangular waveguide access;

a second rectangular waveguide access in alignment with the circular waveguide portion; and a reflector plate disposed between the first access and the second access.

6. The antenna of claim 4, wherein said centrifugally cast main reflector comprises a centrifugally cast plastic and said metallic face comprises a metal coating deposited over said plastic.

7. The antenna of claim 6, wherein said plastic comprises a polyester and said metal coating comprises zinc.

* * * * *